United States Patent [19]

Lands, Jr.

[11] 4,220,212

[45] Sep. 2, 1980

[54] APPARATUS FOR MONITORING THE OPERATION OF WELL BORE GUNS

[75] Inventor: Jack F. Lands, Jr., Houston, Tex.

[73] Assignee: Schlumberger Technology Corporation, New York, N.Y.

[21] Appl. No.: 943,082

[22] Filed: Sep. 18, 1978

[51] Int. Cl.[3] ..... E21B 43/116; E21B 43/117

[52] U.S. Cl. ..... 175/4; 89/1 C; 175/4.57; 175/4.6; 340/669; 340/857

[58] Field of Search ..... 175/4.55, 4.57, 4.6, 175/2, 3, 3.5, 4; 166/65 R, 65 M, 66, 63, 297, 299; 340/669, 857, 856; 89/1 C; 102/216, 21.6, 21

[56] References Cited

U.S. PATENT DOCUMENTS

| | | | |
|---|---|---|---|
| 2,349,041 | 5/1944 | Hare | 340/669 |
| 2,429,240 | 10/1947 | Schlumberger | 175/4.55 |
| 2,732,518 | 1/1956 | Bricaud | 102/21.6 UX |
| 2,871,784 | 2/1959 | Blair | 175/4.55 X |
| 3,202,227 | 8/1965 | Ezran | 175/4 |
| 3,327,791 | 6/1967 | Harrigan, Jr. | 175/4.55 |
| 3,495,212 | 2/1970 | Brock | 340/857 |

*Primary Examiner*—Stephen J. Novosad

[57] ABSTRACT

In the representative embodiment of the new and improved apparatus disclosed herein for monitoring the operation of perforating guns or core-sampling guns carrying one or more electrically-detonatable charges, an impact-actuated monitoring assembly operatively arranged on the body of the gun includes a motion-responsive switch and solenoid device that are connected to the electrical firing circuit of the gun. As the explosive charges connected to the gun-firing circuit are actuated, the new and improved monitoring assembly of the present invention is effective for cyclically varying the impedance of the firing circuit to provide a series of distinctive surface indications showing that the gun has been successfully fired.

27 Claims, 2 Drawing Figures

APPARATUS FOR MONITORING THE OPERATION OF WELL BORE GUNS

Figures 1, 2:
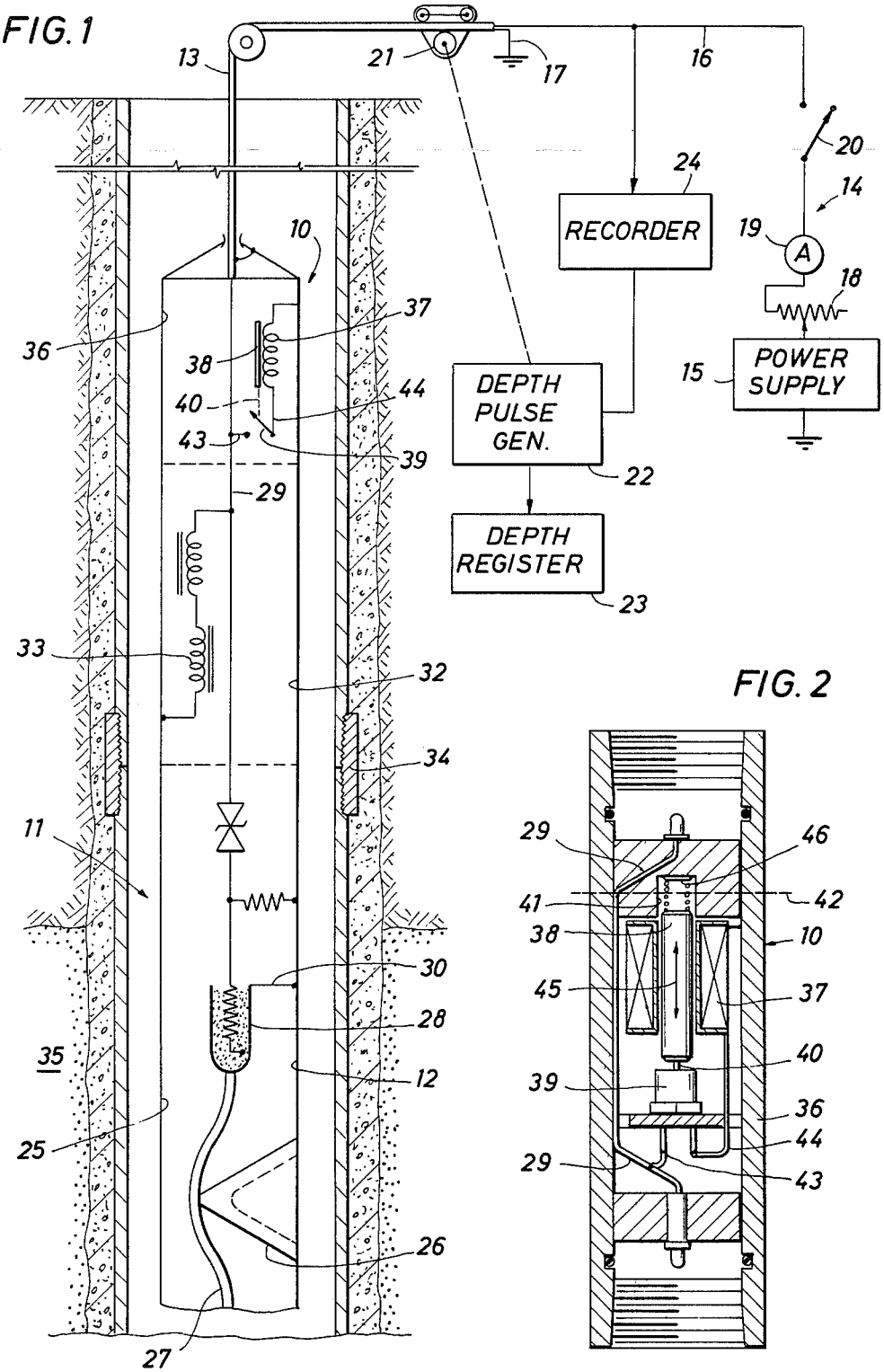

In present-day well-completion operations, it is, of course, quite common for various types of wireline tools to employ one or more selectively-actuated explosive charges. As one example of such tools, samples of formation materials are typically obtained by way of formation-coring guns such as disclosed in U.S. Pat. No. 3,202,227. As described there in more detail, open-ended tubular projectiles or formation-coring bullets are cooperatively arranged in lateral bores spatially disposed along an elongated tool body and adapted to be forcibly propelled against an adjacent formation wall upon detonation of explosive means such as an electrically-responsive detonator or igniter cooperatively associated with an encapsulated explosive charge disposed in the bore behind each of the bullets. Short retaining cables secure the bullets to the gun body so that when the gun is returned to the surface, the formation samples captured within the bullets will be recovered. By actuating the core-sampling tool at one or more selected depth locations in a borehole, representative core samples are obtained from various formation intervals of possible interest which are intersected by the borehole.

As another common example of such wireline tools, one or more shaped explosive charges are supported by a suitable body or carrier and coupled to electrically-responsive explosive detonators which, when actuated, will fire the shaped charges for perforating the adjacent casing and cement sheath lining the borehole walls, U.S. Pat. No. 3,327,791 and U.S. Pat. No. 3,329,218 respectively describe selectively-fired perforating guns having a single charge in each of several reusable heavy-walled tubular carriers. Another perforating gun in widespread use today employs wholly-expendable thin-walled tubular carriers such as those shown in U.S. Pat. No. 3,429,384 which are alternatively arranged in a tandem assembly of either a few long carriers carrying many commonly-fired shaped charges or else a larger number of relatively-short carriers respectively carrying only one or two independently-filed shaped charges.

Those skilled in the art will also appreciate that the satisfactory operation of any of these core-sampling guns or perforating guns requires some arrangement whereby it can be reliably determined when any of the explosive charges on that gun inadvertently fail or misfire rather than letting such mishaps go undetected until after the gun has been returned to the surface. Although a malfunctioning gun can usually be repaired and repositioned in the well bore to repeat the operation as necessary, the additional time required to rectify the situation represents a needless expense. With guns having two or more sets of selectively-fired charges, delays can be minimized if such misfires can be immediately detected so that another charge can be fired before the gun is moved to a different depth location in the well bore.

Various types of so-called "shot-detectors" have, of course, been employed heretofore. For instance, as shown in U.S. Pat. No. 2,871,784, one prior-art system utilizes a concussion-responsive switch that is mounted in the head of a typical multi-shot perforating or coring gun and arranged for briefly interrupting the firing circuit in response to the momentary recoil movements of the gun. Other guns have been provided with a downhole microphone to transmit the sound of the firing of the gun to the surface. These prior-art shot detectors are, however, capable of providing only momentary indications of very-short durations.

Prior to development of the system described in U.S. Pat. No. 3,495,212, it appears that little, if any, consideration had been previously given for a shot detector that would provide a prolonged output indication in response to explosive forces acting on a gun carrying the shot detector. As described in that patent, an acceleration-responsive crystal-controlled oscillator mounted on the head of a perforating or core-sampling gun is arranged for producing a prolonged series of cyclic output signals in response to detonation of the explosive charges mounted in or on the gun. These signals are transmitted by way of the cable to the surface instrumentation of the system. In addition, after a fixed time interval, the signals stop and a relay in that system then functions to interrupt the electrical firing circuit of the gun. Although that system was generally effective, its complexity made the downhole portions of the system excessively long and fairly susceptible to damage from severe service.

Accordingly, it is an object of the present invention to provide new and improved apparatus of a simple and fairly-rugged design for reliably monitoring the operation of well tools having one or more explosively-actuated charges.

This and other objects of the present invention are attained by arranging new and improved shot-monitoring apparatus on a gun adapted for suspension from a suspension cable and carrying one or more electrically-detonatable explosive charges. To monitor the firing of such explosive charges, the new and improved monitoring apparatus of the present invention includes an impact-responsive solenoid device and switching means operatively arranged to cyclically vary the electrical impedance appearing across electrical conductors included with the cable in response to firing of any one or more of the explosive charges carried by the gun assembly.

The novel features of the present invention are set forth with particularity in the appended claims. The invention, together with further objects and advantages thereof, may be best understood by way of the following description of a preferred embodiment of apparatus employing the principles of the invention as illustrated in the accompanying drawing, in which:

FIG. 1 schematically depicts new and improved gun-monitoring apparatus in accordance with the present invention and arranged on a typical perforating gun to show how this apparatus may be employed for conducting a well-perforating operation; and FIG. 2 shows a preferred embodiment of the new and improved gun-monitoring apparatus schematically depicted in FIG. 1.

Turning now to FIG. 1, to illustrate a typical application of the present invention, new and improved shot-monitoring apparatus 10 incorporating the principles of the invention is schematically depicted as it might be arranged with a well bore gun assembly 11 suspended in a cased well bore 12 by means of an armored cable 13 that is spooled on a winch (not shown) adjacent to the well head at the surface and electrically connected to surface instrumentation as shown generally at 14. To control the firing of the gun assembly 11 the surface instrumentation 14 includes a suitable power supply 15 connected to the cable conductors 16 and 17 by way of a rheostat 18, an ammeter 19 and a control switch 20. As is customary, the surface instrumentation 14 further includes a measuring wheel 21 that is frictionally engaged with the cable 13 and, as it is rotatably driven by up and down movements of the suspension cable, drives a depth-pulse generator 22 cooperatively arranged for controlling a depth display register 23 as well as a chart recorder 24 which respectively provide output indicia accurately representing the depth location of the gun assembly 11.

Although either a formation-coring gun as shown in U.S. Pat. No. 3,202,227 or a non-expendable perforating gun as shown in U.S. Pat. No. 3,329,218 could also be used with equal success, the depicted gun assembly 11 includes body means comprising one or more expendable perforating carriers 25 such as those described in U.S. Pat. No. 3,429,384. Rather than being fairly long for carrying a substantial number of charges as represented in the last-mentioned patent, the carrier 25 is instead illustrated as being relatively short and carrying explosive means such as a shaped explosive charge 26 operatively connected by way of a short length of an explosive detonating cord 27 to a typical electrically-responsive detonator 28 that is in turn connected as by conductors 29 and 30 to the cable conductors 16 and 17.

To facilitate accurate positioning of the gun assembly 11 at various depth locations as may be required for perforating different formation intervals, as at 31, intersected by the well bore 12, the body means of the assembly also includes an enclosed housing 32 carrying a typical collar locator 33 and preferably tandemly arranged just above the perforating carrier 25. Positioning devices such as the collar locator 33 will, of course, provide output signals on the recorder 24 which facilitate correlating the depth of the gun assembly 11 in relation to the several casing collars, as at 34, disposed along the casing string in the well bore 12. If desired, the gun assembly could also include a typical gamma radiation detector (not shown) which would be utilized either by itself or in conjunction with the collar locator 33 for accurately positioning the assembly 11 in relation to formations, as at 35, having distinctive radioactivity characteristics.

In keeping with the objects of the present invention, the new and improved shot-monitoring apparatus 10 is preferably arranged in an enclosed housing 36 tandemly disposed in the gun assembly 11 just above the housing 32 for the collar locator 33. As best illustrated in FIG. 2, in its preferred embodiment the monitoring apparatus 10 includes a typical solenoid device including an annular coil 37 of fairly-low electrical impedance that is coaxially secured within the housing 36 and adapted to loosely carry an axially-movable core member or plunger 38 having suitable ferromagnetic properties as to be drawn further into the coil when it is energized. The monitoring apparatus 10 further includes a normally-open switch, as at 39, which is secured to the housing 36 and cooperatively positioned adjacent to the solenoid coil so that this switch will be closed only in response to acceleration forces which exceed a predetermined minimum level of sufficient magnitude as may be required for achieving relative longitudinal movement between the plunger 38 and the solenoid 37. In the preferred mode of achieving selective impact-responsive operation of the new and improved monitoring apparatus 10, the plunger 38 is arranged to normally rest upon the actuating member 40 of the switch 39. In this preferred embodiment, the dead weight of the movable plunger alone is, however, arranged to be incapable of closing the switch 39 so long as the gun assembly 11 is either stationary or else is moving so slowly that, at best, there is only a slight and ineffectual increase in the overall load imposed on the switch actuator 40 by any minor inertial forces acting on the plunger 38. If necessary, a light spring (not shown) can be employed for supporting a portion of the weight of the plunger 38. It should also be recognized from FIG. 2 that when it is in this intermediate or at-rest position resting on the actuator 40, the plunger 38 is preferably displaced longitudinally below the mid-point of the solenoid coil 37; and, by virtue of small clearance space 41 above the plunger, it is also free to be pulled axially upwardly to a higher longitudinally-centered operating position 42 within the coil as it is energized. As depicted, the new and improved monitoring apparatus 10 is electrically connected in the gun assembly 11 by way of conductors 43 and 44 that serially interconnect the solenoid coil 37 and the movement-responsive switch 39 to the main conductor 29.

So long as the movement-responsive switch 39 remains open, electrical current cannot flow through the coil 37 and the plunger 38 will correspondingly remain in its normal longitudinally-displaced or at-rest position in relation to the solenoid coil. Similarly, the solenoid coil 37 will remain de-energized regardless of whether the movement-responsive switch 39 is open or closed so long as the control switch 20 at the surface is not operated to connect the power supply 15 to the cable 13.

It will be recognized, therefore, that the new and improved monitoring apparatus 10 of the present invention is ordinarily not in readiness for operation until the gun assembly 11 has been properly positioned in the well bore 12 and the control switch 20 in the surface instrumentation 14 is closed for connecting the power supply 15 to the cable 13. Those skilled in the art will, of course, also appreciate that after the control switch 20 is closed, the rheostat 18 must then be advanced until the detonator 28 in the gun assembly 11 is fired. Similarly, when the monitoring apparatus 10 is used in conjunction with a typical core-sampling gun, corresponding steps must be taken before the explosive initiators on the gun are fired.

In a typical perforating operation, the gun assembly 11 will usually be positioned at a desired depth location as required for perforating a given formation, as at 35, before closing the control switch 20 and advancing the rheostat 18. The switch 39 will, of course, be open since at that time there are little or no inertial or accelerational forces acting on the plunger 38 and the dead weight of the plunger alone is sufficient to close the movement-responsive switch. Upon movement of the rheostat 18 to an advanced position, the detonator 28 will ordinarily be fired so as to detonate the shaped charge 26 in the usual fashion.

Those skilled in the art will appreciate that since the housing 36 is effectively coupled to the shaped charge 26, when the charge is detonated the gun assembly 11 will be subjected to an accelerational or impact force of substantial magnitude which will be effective for causing the gun assembly to jump upwardly. This sudden upward movement of the gun assembly 11 will, of course, be effective for momentarily closing the switch 39 since the motion-responsive switch will be carried upwardly in relation to the freely-movable plunger 38 which, due to its inertia, will momentarily remain relatively stationary. Since the power supply 15 is still connected to the main conductor 29, when the plunger 38 is in its lower operating position the momentary closure of the motion-responsive switch 39 will energize the solenoid coil 37; and the resulting electromagnetic field will, in turn, pull the plunger to its elevated position as shown by the dashed lines 42. Once the plunger 38 is elevated, the normally-open switch 39 will, of course, reopen and therey de-energize the solenoid coil 37. When this occurs, gravity will cause the plunger 38 to fall from its upper operating position to its illustrated full-line lower operating position and strike the swtich actuator 40 with sufficient impact to reclose the movement-responsive switch 39. Closure of the switch 39 will, of course, be effective for reenergizing the solenoid coil 37 and returning the plunger 38 to its elevated position. This upward and downward cyclic movement of the plunger 38 (as schematically represented by the double-headed arrow 45) will, of course, continue so long as the control switch 20 remains closed and the rheostat 18 is sufficiently advanced that the solenoid cell 37 will be momentarily energized each time the motion-responsive switch 39 is reclosed by the previous fall of the plunger. It should also be noted that although gravity biasing of the plunger 38 is sufficient to assure reclosure of the switch 39, the return movement of the plunger could be augmented by other biasing means such as a spring, as at 46, in the clearance space 41 and arranged to be energized only upon upward travel of the plunger.

Those skilled in the art will recognize, therefore, that each time the switch 39 is closed the solenoid coil 37 will be electrically interconnected across the lower end of the cable conductors 16 and 17. Conversely, each time the plunger 38 is elevated, the switch 39 will open and the solenoid coil 37 will no longer be connected to the lower end of the cable conductor 16. Thus, the total impedance coupled across the lower ends of the cable conductors 16 and 17 will be cyclically varied at the frequency of the relatively-slow reciprocating movements 45 of the plunger 38. Although coil elements with impedances of a few hundred ohms could be employed it is preferred that the impedance of the coil 37 be no greater than about 50 to 100-ohms. In this way should there be a low-resistance short across the conductor 29 due to entrance of conductive well bore fluids into the carrier 25, there will still be a significant current change each time the switch 39 opens or closes. These cyclic changes in electrical impedance will, of course, produce characteristic visual indicia on the ammeter 19 and the recorder 24 and thereby provide reliable evidence at the surface that the shaped charge 26 had been successfully detonated. Since these cyclic output signals cannot be initiated unless the gun assembly 11 is initially subjected to a significant impact force (such as when the shaped charge 26 is detonated), it will be recognized that the cyclic signals produced by the new and improved monitoring apparatus 10 of the present invention will be sufficient for providing reliable surface indications each time an explosive is detonated or a coring bullet is fired.

While only a particular embodiment of the present invention has been shown and described, it is apparent that changes and modifications may be made without departing from this invention in its broader aspects; and, therefore, the aim in the appended claims is to cover all such changes and modifications as fall within the true spirit and scope of this invention.

What is claimed is:

1. Well bore apparatus comprising:

body means;

means on said body means adapted for coupling a detonatable explosive device to said body means; and means on said body means adapted for cyclically varying the electrical impedance appearing across electrical conductors of a cable supporting said body means and including electrical solenoid means having a coil member and a ferromagnetic member cooperatively arranged and adapted for movement in relation to one another whereby one of said solenoid members will be initially placed in one operating position in response to explosive forces imposed on said body means and will thereafter be moved toward another operating position in response to electromagnetic forces imposed on said ferromagnetic member upon energization of said coil member, and switch means cooperatively associated with said one solenoid member adapted to be closed when said one solenoid member is in its said one operating position for connecting said coil member to electrical-source means and to be opened upon movement of said one solenoid member toward its said other operating position for disconnecting said coil member so that following its said initial placement in said one operating position said one solenoid member will thereafter be moved back and forth between its said operating positions as said coil member is cyclically energized and de-energized.

2. The well bore apparatus of claim 1 wherein said one solenoid member is said ferromagnetic member.

3. The well bore apparatus of claim 1 further including means cooperatively arranged and adapted for biasing said one solenoid member toward its said one operating position following movement of said one solenoid member to its said other operating position.

4. The well bore apparatus to claims 1, 2 or 3 wherein said solenoid members are coaxially arranged on said body means and said one solenoid member is cooperatively arranged and adapted for movement along the longitudinal axis of said body means.

5. The well bore apparatus of claim 1 wherein said other operating position is higher than said one operating position and the weight of said one solenoid member is operative for biasing said one solenoid member toward its said one operating position following movement thereof to its said other operating position.

6. The well bore apparatus of claim 1 further including spring means cooperative upon movement of said one solenoid member toward its said other operating position for biasing said one solenoid member toward its said one operating position.

7. The well bore apparatus according to claims 5 or 6 wherein said one solenoid member is said ferromagnetic member.

8. Well bore apparatus comprising:

a housing adapted to be coupled to a well tool carrying an explosive device; and means operable in response to explosive forces on said housing and adapted for cyclically varying the electrical impedance appearing across electrical conductors of a cable supporting said housing and including electrical solenoid means within said housing having a solenoid coil coaxially mounted therein and a ferromagnetic core member movable in relation to said solenoid coil in response to accelerational forces and cooperatively arranged for upward and downward movement in relation thereto between a lower operating position spatially disposed from said solenoid coil and a higher operating position closer to said solenoid coil, and normally-open switch means electrically connected to said solenoid coil and cooperatively associated with said core member for being closed to energize said solenoid coil when said core member is in its said lower operating position and for being opened to de-energize said solenoid coil upon upward movement of said core member toward its said upper operating position whereby an explosive shock imposed on said housing of sufficient magnitude to initially place said core member in its said lower operating position will be effective for thereafter causing said core member to move upwardly and downwardly between its said operating positions to produce said cyclical impedance variations so long as an electrical source is operatively connected to said switch means and said solenoid coil.

9. The well bore apparatus of claim 8 wherein following movement of said core member toward its said upper operating position, the weight of said core member will bias said core member toward its said lower operating position with sufficient acceleration force due to gravity to close said switch means.

10. The well bore apparatus of claim 8 further including spring means cooperatively associated with said core member and operative upon movement of said core member toward its said upper operating position for biasing said core member toward its said lower operating position with sufficient acceleration force to close said switch means.

11. The well bore apparatus of claim 8 wherein said core member also has an intermediate at-rest position located between its said upper and lower operating positions, and the weight of said core member is inadequate for closing said switch means so long as said core member is in its said at-rest position but is adequate to produce sufficient accelerational forces for closing said switch means either upon downward gravitational movement of said core member from its said upper operating position or upon relative downward movement of said core member from its said at-rest position in response to explosive forces on said housing.

12. A gun assembly comprising:

body means adapted to be supported in a well bore by electrical-conductor means;

electrically-responsive explosive means on said body means; and means on said body means adapted for cyclically varying the termination impedance appearing across electrical-conductor means supporting said body means and including a solenoid coil, a ferromagnetic member cooperatively arranged for back-and-forth movements relative to said solenoid coil and movable in one direction toward one operating position in response to accelerational forces acting thereon and movable in the opposite direction toward another operating position in response to electromagnetic forces produced by energization of said solenoid coil and electrical switch means operable in response to said back-and-forth movements of said movable member and adapted for alternatively closing and opening to connect and disconnect said solenoid coil to and from electrical-conductor means supporting said body means whereby an accelerational force imposed on said movable member by detonation of said explosive means that is sufficient to initially place said movable member in its said one operating position will thereafter be effective for then moving said movable member back and forth between its said operating positions to cyclically connect and disconnect said solenoid coil to and from electrical conductor means supporting said body means and connected to an electrical source.

13. The gun assembly of claim 12 wherein said electrically-responsive explosive means include electrically-actuated detonating means adapted to be connected to electrical-conductor means supporting said body means.

14. The gun assembly of claim 13 wherein said electrically-responsive explosive means further include a shaped-explosive charge operatively associated with and adapted to be fired upon detonation of said detonating means.

15. The gun assembly of claim 13 wherein said electrically-responsive explosive means further include a formation-coring bullet operatively associated with and adapted to be fired upon detonation of said detonating means.

16. The gun assembly of claim 12 wherein said other operating positions of said movable member is higher than is said one operating position so that upon movement of said movable member upwardly to its said other operating position, said switch means will open for disconnecting said solenoid coil and allowing said movable member to fall back to its said one operating position with sufficient accelerational force due to gravity to reclose said switch means for reconnecting said solenoid coil.

17. The gun assembly of claim 12 further including spring means cooperatively associated with said movable member and operative upon movement of said movable member toward its said other operating position for biasing said movable member downwardly toward its said one operating position with sufficient accelerational force to close said switch means.

18. The gun assembly of claim 12 wherein said other operating position of said movable member is higher than its said one operating position and said movable member also has an intermediate at-rest position located between its said one and other operating positions, and the weight of said movable member is inadequate for closing said switch means so long as said movable member is in its said at-rest position but is adequate to produce sufficient accelerational forces for closing said switch means either upon downward gravitational movement of said movable member from its said upper operating position or upon relative downward movement of said movable member from its said at-rest position in response to explosive forces on said body means.

19. The gun assembly according to claims 12, 16, 17 or 18 wherein said solenoid coil is coaxially arranged on said body means and said movable member is cooperatively arranged and adapted for longitudinal movement along the longitudinal axis of said body means.

20. Well bore apparatus comprising:

a gun assembly including body means and detonatable explosive means on said body means;

a suspension cable coupled to and dependently supporting said body means in a well bore and including electrical-conductor means extending between the surface and sub-surface ends of said cable;

an electrical source adapted for connection to said electrical-conductor means adjacent to said surface end of said cable; and impact-initiated monitoring means operable in response to detonation of said explosive means for providing a series of distinctive indications at the surface and including normally-open switch means on said body means, a solenoid coil on said body means, conductor means for serially connecting said switch means and said solenoid coil to said electrical-conductor means adjacent to said subsurface end of said cable, switch-actuating means including a ferromagnetic core member movable in relation to said solenoid coil toward a switch-closing position in response to accelerational forces and toward a switch-opening position in response to electromagnetic forces produced upon energization of said solenoid coil and means adapted for connection to said electrical-conductor means adjacent to said surface end of said cable for producing output indicia representative of changes in impedance appearing across said electrical-conductor means as said core member is initially placed in its said switch-closing position in response to detonation of said explosive means and is thereafter moved back and forth between its said switch-opening and switch-closing positions to produce cyclical impedance changes across said electrical-conductor means as long as said electrical source is connected thereto.

21. The well bore apparatus of claim 20 wherein said explosive means include electrically-actuated detonating means connected to said electrical-conductor means.

22. The well bore apparatus of claim 21 wherein said explosive means further include a shaped-explosive charge operatively associated with and adapted to be fired upon detonation of said detonating means.

23. The well bore apparatus of claim 21 wherein said explosive means further include a formation-coring bullet operatively associated with and adapted to be fired upon detonation of said detonating means.

24. The well bore apparatus of claim 20 wherein said switch-opening position of said core member is higher than its said switch-closing position so that upon movement of said core member upwardly to its said switch-opening position said switch means will open for disconnecting said solenoid coil from said electrical-conductor means and allowing said core member to fall back to its said switch-opening position with sufficient accelerational force due to gravity to reclose said switch means for reconnecting said solenoid coil to said electrical-conductor means.

25. The well bore apparatus of claim 20 further including spring means cooperatively associated with said core member and operative upon its movement toward its said switch-opening position for biasing said core member downwardly toward its said switch-opening position with sufficient accelerational force to close said switch means.

26. The well bore apparatus of claim 20 wherein said switch-opening position of said core member is higher than its said switch-closing position and said core member also has an intermediate at-rest position located between its said operating positions, and the weight of said core member is inadequate for closing said switch means so long as said core member is in its said at-rest position but is adequate to produce sufficient accelerational forces for closing said switch means either upon downward gravitational movement of said core member from its said upper operating position or upon relative downward movement of said core member from its said at-rest position in response to explosive forces on said housing.

27. The well bore apparatus according to claims 20, 24, 25 or 26 wherein said solenoid coil is coaxially arranged on said body means and said core member is cooperatively arranged and adapted for longitudinal movement along the longitudinal axis of said body means.

* * * * *